US009716957B2

(12) United States Patent
Yuen

(10) Patent No.: US 9,716,957 B2
(45) Date of Patent: Jul. 25, 2017

(54) HEADSET CAPABLE OF CONVERTING SOUND CHANNELS

(71) Applicant: Innovation Sound Technology Co., Ltd., Shenzhen, Guangdong (CN)

(72) Inventor: Shunming Yuen, Hong Kong (CN)

(73) Assignee: INNOVATION SOUND TECHNOLOGY CO., LTD., Shenzhen, Guangdong (CN)

( * ) Notice: Subject to any disclaimer, the term of this patent is extended or adjusted under 35 U.S.C. 154(b) by 86 days.

(21) Appl. No.: 14/787,445

(22) PCT Filed: Apr. 28, 2013

(86) PCT No.: PCT/CN2013/074942
§ 371 (c)(1),
(2) Date: Oct. 27, 2015

(87) PCT Pub. No.: WO2014/176723
PCT Pub. Date: Nov. 6, 2014

(65) Prior Publication Data

US 2016/0105756 A1 Apr. 14, 2016

(51) Int. Cl.
*H04R 5/02* (2006.01)
*H04S 1/00* (2006.01)
(Continued)

(52) U.S. Cl.
CPC ..... *H04S 1/005* (2013.01); *H04R 1/1041* (2013.01); *H04R 5/033* (2013.01); *H04R 3/12* (2013.01); *H04R 5/0335* (2013.01); *H04R 5/04* (2013.01)

(58) Field of Classification Search
USPC ..... 381/74, 309, 370, 371, 374, 378, 379, 381/377
See application file for complete search history.

(56) References Cited

U.S. PATENT DOCUMENTS

2009/0154720 A1* 6/2009 Oki ..... H04R 1/1041 381/74
2013/0272560 A1* 10/2013 Dougherty ..... H04R 1/1066 381/378

FOREIGN PATENT DOCUMENTS

CN 2344936 Y 10/1999
CN 201718022 U 1/2011
CN 203193849 U 9/2013

OTHER PUBLICATIONS

International Search Report date of mailing Jan. 30, 2014 for PCT/CN2013/074942 (3 pgs).

* cited by examiner

*Primary Examiner* — Yosef K Laekemariam
(74) *Attorney, Agent, or Firm* — Fitch, Even, Tabin & Flannery LLP

(57) ABSTRACT

A type of channel-convertible headphone is disclosed in the utility model which comprises: The left speaker, the first articulated switch, the second articulated switch, the right speaker, the left channel input terminal and the right channel input terminal, wherein, the first articulated switch is provided with the first and the second electronic contact and the second articulated switch with the third and the fourth electronic contact which can switch off or on the connection; the left speaker is connected to the third electronic contact through the first electronic contact and the second electronic contact to the right speaker through the fourth electronic contact; the left channel input terminal is connected to the left speaker through the first electronic contact and the right channel input terminal to the right speaker through the second electronic contact. Application of the channel-convertible headphone of the utility model can maintain the left and right channels in such a manner that they output same audio content and realize conversion between signal and (Continued)

double channels by turning the headphone switch and build a reasonable structure for easy control of the cost.

18 Claims, 2 Drawing Sheets

(51) Int. Cl.

| | |
|---|---|
| ***H04R 1/10*** | (2006.01) |
| *H04R 3/12* | (2006.01) |
| *H04R 5/033* | (2006.01) |
| *H04R 5/04* | (2006.01) |

HEADSET CAPABLE OF CONVERTING SOUND CHANNELS

FIELD OF THE INVENTION

The utility model relates to a type of headphone, more specifically, a type of headphone which is convertible between single channel and double channels.

BACKGROUND OF THE INVENTION

Headphones of the prior art feature unreasonable structure design due to the problem as follows: the left and right channels output different audio content or are unable to distinguish ambient sound, which is a ready cause of user loss of audio content. Therefore, it is deemed necessary to design a single and double channel convertible headphone which is operated such that the left or right speaker is controlled by simply turning the switch.

DESCRIPTION OF THE UTILITY MODEL

The technical problem to be solved by the utility model is to provide a channel-convertible headphone to maintain the left and right channels in such a manner that they output same audio content and realize conversion between single and double channels by turning the headphone switch, and to build a reasonable structure for easy control of the cost.

To solve the technical problem, a channel-convertible headphone is provided in the embodiments of the utility model which comprises the left speaker, the first articulated switch, the second articulated switch, the right speaker, the left channel input terminal and the right channel input terminal, wherein: the first articulated switch is provided with the first and the second electronic contact and the second articulated switch with the third and the fourth electronic contact which can switch off or on the connection; the left speaker is connected to the third electronic contact through the first electronic contact and the second electronic contact to the right speaker through the fourth electronic contact; the left channel input terminal is connected to the left speaker through the first electronic contact and the right channel input terminal to the right speaker through the second electronic contact; the left speaker and the right speaker output in the single-channel mode when connection to the first articulated switch and/or the second articulated switch is on.

Wherein, the headphone also comprises the signal source terminal 7 to which the left speaker and the right speaker are respectively connected. Wherein, the left speaker and the right speaker output in the double-channel mode when the connection to the first articulated switch and the second articulated switch is off.

Wherein, the first resistor is connected between the left channel input terminal and the first electronic contact. Wherein, the second resistor is connected between the right channel input terminal and the second electronic contact. Another technical scheme to be adopted to solve the technical problem is to: A type of channel-convertible headphone is disclosed which comprises: The left speaker, the first articulated switch, the second articulated switch, the right speaker, the left channel input terminal and the right channel input terminal, wherein, the first articulated switch is provided with the first and the second electronic contact and the second articulated switch with the third and the fourth electronic contact which can switch off or on the connection; the left speaker is connected to the third electronic contact through the first electronic contact and the second electronic contact to the right speaker through the fourth electronic contact; the left channel input terminal is connected to the left speaker through the first electronic contact and the right channel input terminal to the right speaker through the second electronic contact; the first resistor is connected between the left channel input terminal and the first electronic contact and the second resistor between the right channel input terminal and the second electronic contact.

Wherein, the left speaker and the right speaker output in the single-channel mode when connection to the first articulated switch and/or the second articulated switch is on. Wherein, the left speaker and the right speaker output in the double-channel mode when the connection to the first articulated switch and the second articulated switch is off.

Wherein, the headphone also comprises the signal source terminal 7 to which the left speaker and the right speaker are respectively connected.

Another technical scheme to be adopted to solve the technical problem is to: A type of channel-convertible headphone is disclosed which comprises: The left speaker, the first articulated switch, the second articulated switch, the right speaker, the left channel input terminal and the right channel input terminal, wherein, the first articulated switch is provided with the first and the second electronic contact and the second articulated switch with the third and the fourth electronic contact which can switch off or on the connection; the left speaker is connected to the third electronic contact through the first electronic contact and the second electronic contact to the right speaker through the fourth electronic contact; the left channel input terminal is connected to the left speaker through the first electronic contact and the right channel input terminal to the right speaker through the second electronic contact.

Wherein, the headphone also comprises the signal source terminal 7 to which the left speaker and the right speaker are respectively connected.

Wherein, the first resistor is connected between the left channel input terminal and the first electronic contact.

Wherein, the second resistor is connected between the right channel input terminal and the second electronic contact.

Wherein, the left speaker and the right speaker output in the single-channel mode when connection to the first articulated switch and/or the second articulated switch is on.

Wherein, the left speaker and the right speaker output in the double-channel mode when the connection to the first articulated switch and the second articulated switch is off. Application of the channel-convertible headphone of the utility model could render beneficial effects as follows: since the left speaker is connected to the third electronic contact through the first electronic contact and the second electronic contact to the right speaker through the fourth electronic contact, the left speaker and the right speaker can output in the single-channel mode when connection to the first articulated switch and/or the second articulated switch is on and in the double-channel mode when the connection to the first articulated switch and the second articulated switch is off. The structure can maintain the left and right channels in such a manner that they output same audio content and realize conversion between signal and double channels by turning the headphone switch and build a reasonable structure for easy control of the cost.

BRIEF INTRODUCTION OF THE DRAWINGS

DETAILED DESCRIPTION OF THE PREFERRED EMBODIMENTS

Figure 1:
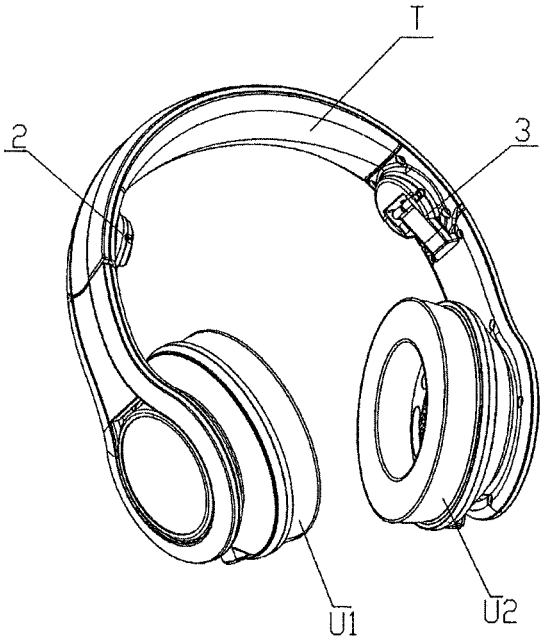
FIG. 1 is a schematic view of the external structure of the channel-convertible headphone in an embodiment of the utility model.
Figure 2:
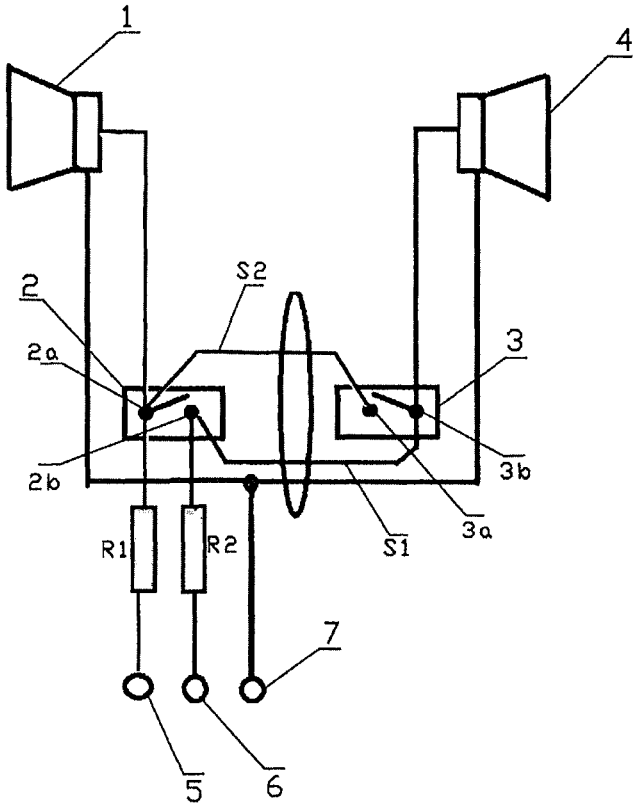
FIG. 2 is a schematic view of the circuit structure of the channel-convertible headphone in an embodiment of the utility model.

The preferred embodiments of the invention are described hereinafter in reference to the accompanying drawings. FIG. 1 and FIG. 2 incorporate one of the embodiments of the channel-convertible headphone of the utility model.

As shown in FIG. 1 the schematic view of the external structure of the channel-convertible headphone in an embodiment of the utility model, the headphone in the embodiment is of an external form by and large similar to that of the headphone in the prior art and has the left speaker 1 and the right speaker 4 disposed respectively inside ear cup U1 and U2, but its external form differs in that the first articulated switch 2 and the second articulated switch 3 are disposed respectively at the two ends of the T-shaped head wearing yoke between ear cup U1 and U2.

Articulated switch 2 and 3 are respectively connected to the connecting circuits disposed in the T-shaped head wearing yoke to realize conversion between the left and right channels of the headphone by switching on or off the corresponding connecting circuit. Ear cup U1 and U2 in the embodiment are turnable to turn on or off the first articulated switch 2 and the second articulated switch 3. During the application, ear cup U1 and U2 are pretty much like a switch that controls the connection and disconnection of the first articulated switch 2 and the second articulated switch 3.

FIG. 2 is a schematic view of the circuit structure of the channel-convertible headphone in an embodiment of the utility model, which comprises: the left speaker 1, the first articulated switch 2, the second articulated switch 3, the right speaker 4, the left channel input terminal 5 and the right channel input terminal 6, wherein:

The first articulated switch 2 is provided with the first electronic contact 2*a* and the second electronic contact 2*b* and the second articulated switch 3 with the third electronic contact 3*a* and the fourth electronic contact 3*b* which can switch off or on the connection;

The left speaker 1 is connected to the third electronic contact 3*a* through the first electronic contact 2*a* and the second electronic contact 2*b* to the right speaker 4 through the fourth electronic contact 3*b;*

The left channel input terminal 5 is connected to the left speaker 1 through the first electronic contact 2*a* and the right channel input terminal 6 to the right speaker 4 through the second electronic contact 2*b*.

Preferably, the headphone also comprises the signal source terminal 7 to which the left speaker 1 and the right speaker 4 are respectively connected.

According to the circuit structure as shown in FIG. 2, connection of the left speaker 1 and the right speaker 4 can be realized by turning the first articulated switch 2 and the second articulated switch 3 on the T-shaped head wearing yoke of the headphone of the utility model. When series-connected into a whole, the left speaker 1 and the right speaker 4 can output a single channel and maintain the left and right channels in such a manner that they output same audio content. While the left speaker 1 and the right speaker 4 are in output state, the user would be less likely to lose the audio content and could readily hear the ambient sound.

Further, the left speaker 1 is connected to the left channel input terminal 5 through the first electronic contact 2*a* and the right speaker 4 to the right channel input terminal 6 through the fourth electronic contact 3*b*, the electric wire S1 and the second electronic contact 2*b*. In other words, when the user turns the ear cup U1 and U2 to disconnect the first articulated switch 2 and the second articulated switch 3, the left speaker 1 and the right speaker 4 output in the double-channel mode and the user is able to hear stereo.

Further, when the first articulated switch 2 is closed to turn on the first electronic contact 2*a* and the second electronic contact 2*b*, the left speaker 1 is series-connected with the right speaker 4 through the electric wire S1 between the second electronic contact 2*b* and the fourth electronic contact 3*b*. In other words, when the user turns the ear cup U1 to connect the first articulated switch 2 and disconnect the second articulated switch 3, the left speaker 1 and the right speaker 4 output in the single-channel mode.

Further, when the second articulated switch 3 is closed to turn on the third electronic contact 3*a* and the fourth electronic contact 3*b*, the right speaker 4 is series-connected with the left speaker 1 through the electric wire S2 between the first electronic contact 2*a* and the third electronic contact 3*a*. In other words, when the user turns the ear cup U2 to connect the second articulated switch 3 and disconnect the first articulated switch 2, the left speaker 1 and the right speaker 4 output in the single-channel mode.

It could be understood such that, when the user turns the ear cup U1 and U2 simultaneously to connect the first articulated switch 2 and the second articulated switch 3, the left speaker 1 and the right speaker 4 are series-connected and output in the single-channel mode.

Preferably, the first resistor R1 is connected between the left channel input terminal 5 and the first electronic contact 2*a* and the second resistor R2 between the right channel input terminal 6 and the second electronic contact 2*b*.

Application of the channel-convertible headphone of the utility model shall be such that, since the left speaker is connected to the third electronic contact through the first electronic contact and the second electronic contact to the right speaker through the fourth electronic contact, the left speaker and the right speaker can output in the single-channel mode when connection to the first articulated switch and/or the second articulated switch is on and in the double-channel mode when the connection to the first articulated switch and the second articulated switch is off. The structure can maintain the left and right channels in such a manner that they output same audio content and realize conversion between signal and double channels by turning the headphone switch and build a reasonable structure for easy control of the cost.

Only the preferred embodiments of the invention are disclosed which surely are not intended to limit the scope of protection of the invention. Therefore, equivalent changes made in accordance with the Claims of the invention are still covered within the scope of the invention.

The invention claimed is:

1. A type of channel-convertible headphone which comprises: a left speaker, a first articulated switch, a second articulated switch, a right speaker, a left channel input terminal and a right channel input terminal, wherein:

the said first articulated switch is provided with a first and a second electronic contact and the said second articulated switch is provided with a third and a fourth electronic contact which can switch off or on the connection; the said left speaker is connected to the said third electronic contact through the said first electronic contact and the said second electronic contact to the said right speaker through the said fourth electronic contact; the said left channel input terminal is connected to the said left speaker through the said first electronic contact and the said right channel input terminal to the said right speaker through the said second electronic contact; and the said left speaker and the said right speaker output in the single-channel mode when connection to the said first articulated switch and/or the said second articulated switch is on.

2. The channel-convertible headphone according to claim 1 is such that, the said headphone also comprises a signal source terminal to which the said left speaker and the said right speaker are respectively connected.

3. The channel-convertible headphone according to claim 2 is such that, the said left speaker and the said right speaker output in the double-channel mode when connection to the said first articulated switch and the said second articulated switch is off.

4. The channel-convertible headphone according to claim 1 is such that, the first resistor is connected between the said left channel input terminal and the said first electronic contact.

5. The channel-convertible headphone according to claim 1 is such that, the second resistor is connected between the said right channel input terminal and the said second electronic contact.

6. A type of channel-convertible headphone which comprises: a left speaker, a first articulated switch, a second articulated switch, a right speaker, a left channel input terminal and a right channel input terminal, wherein:

the said first articulated switch is provided with a first and a second electronic contact and the said second articulated switch is provided with a third and a fourth electronic contact which can switch off or on the connection;

the said left speaker is connected to the said third electronic contact through the said first electronic contact and the said second electronic contact to the said right speaker through the said fourth electronic contact; the said left channel input terminal is connected to the said left speaker through the said first electronic contact and the said right channel input terminal to the said right speaker through the said second electronic contact; and a first resistor is connected between the said left channel input terminal and the said first electronic contact and a second resistor is connected between the said right channel input terminal and the said second electronic contact.

7. The channel-convertible headphone according to claim 6 is such that, the said left speaker and the said right speaker output in the single-channel mode when connection to the said first articulated switch and I or the said second articulated switch is on.

8. The channel-convertible headphone according to claim 6 is such that, the said left speaker and the said right speaker output in the double-channel mode when connection to the said first articulated switch and the said second articulated switch is off.

9. The channel-convertible headphone according to claim 7 is such that, the said left speaker and the said right speaker output in the double-channel mode when connection to the said first articulated switch and the said second articulated switch is off.

10. The channel-convertible headphone according to claim 6 is such that, the said headphone comprises a signal source terminal to which the said left speaker and the said right speaker are respectively connected.

11. The channel-convertible headphone according to claim 10 is such that, the said left speaker and the said right speaker output in the single-channel mode when connection to the said first articulated switch and I or the said second articulated switch is on.

12. The channel-convertible headphone according to claim 11 is such that, the said left speaker and the said right speaker output in the double-channel mode when connection to the said first articulated switch and the said second articulated switch is off.

13. A type of channel-convertible headphone which comprises: a left speaker, a first articulated switch, a second articulated switch, a right speaker, a left channel input terminal and a right channel input terminal, wherein:

the said first articulated switch is provided with a first and a second electronic contact and the said second articulated switch is provided with a third and a fourth electronic contact which can switch off or on the connection;

the said left speaker is connected to the said third electronic contact through the said first electronic contact and the said second electronic contact to the said right speaker through the said fourth electronic contact; and the said left channel input terminal is connected to the said left speaker through the said first electronic contact and the said right channel input terminal is connected to the said right speaker through the said second electronic contact.

14. The channel-convertible headphone according to claim 13 is such that, the said headphone comprises a signal source terminal to which the said left speaker and the said right speaker are respectively connected.

15. The channel-convertible headphone according to claim 13 is such that, the first resistor is connected between the said left channel input terminal and the said first electronic contact.

16. The channel-convertible headphone according to claim 13 is such that, the second resistor is connected between the said right channel input terminal and the said second electronic contact.

17. The channel-convertible headphone according to claim 13 is such that, the said left speaker and the said right speaker output in the single-channel mode when connection to the said first articulated switch and I or the said second articulated switch is on.

18. The channel-convertible headphone according to claim 17 is such that, the said left speaker and the said right speaker output in the double-channel mode when connection to the said first articulated switch and the said second articulated switch is off.

* * * * *